US009153240B2

(12) United States Patent
Briand et al.

(10) Patent No.: US 9,153,240 B2
(45) Date of Patent: Oct. 6, 2015

(54) TRANSFORM CODING OF SPEECH AND AUDIO SIGNALS

(71) Applicant: Telefonaktiebolaget L M Ericsson (publ), Stockholm (SE)

(72) Inventors: Manuel Briand, Djursholm (SE); Anisse Taleb, Kista (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 1 day.

(21) Appl. No.: 13/939,931

(22) Filed: Jul. 11, 2013

(65) Prior Publication Data

US 2014/0142956 A1 May 22, 2014

Related U.S. Application Data

(63) Continuation of application No. 12/674,117, filed as application No. PCT/SE2008/050967 on Aug. 26, 2008, now abandoned.

(60) Provisional application No. 60/968,159, filed on Aug. 27, 2007, provisional application No. 61/044,248, filed on Apr. 11, 2008.

(51) Int. Cl.
*G10L 19/02* (2013.01)
*G10L 19/035* (2013.01)

(52) U.S. Cl.
CPC ..... *G10L 19/0204* (2013.01); *G10L 19/0212* (2013.01); *G10L 19/035* (2013.01)

(58) Field of Classification Search
CPC ..... G10L 19/02; G10L 19/0204; G10L 25/18; G10L 19/035
USPC ..... 714/200.1, 203, 205, 500, 501; 704/200.1, 203, 205, 500, 501, 224, 704/229
See application file for complete search history.

(56) References Cited

U.S. PATENT DOCUMENTS 5,079,547 A 1/1992 Fuchigama et al. ..... 341/51
5,508,949 A 4/1996 Konstantinides ..... 708/402
(Continued)

FOREIGN PATENT DOCUMENTS

EP 0402973 A1 12/1990
EP 0967593 A1 12/1999
(Continued)

OTHER PUBLICATIONS

Office Action issued in corresponding Japanese patent application No. 2010-522867 on Dec. 17, 2012, 2 pages.
(Continued)

*Primary Examiner* — Martin Lerner
(74) *Attorney, Agent, or Firm* — Rothwell, Figg, Ernst & Manbeck, P.C.

(57) ABSTRACT

In a method of perceptual transform coding of audio signals in a telecommunication system, performing the steps of determining transform coefficients representative of a time to frequency transformation of a time segmented input audio signal; determining a spectrum of perceptual sub-bands for said input audio signal based on said determined transform coefficients; determining masking thresholds for each said sub-band based on said determined spectrum; computing scale factors for each said sub-band based on said determined masking thresholds, and finally adapting said computed scale factors for each said sub-band to prevent energy loss for perceptually relevant sub-bands.

10 Claims, 8 Drawing Sheets

(56) References Cited

U.S. PATENT DOCUMENTS

| | | | | |
|---|---|---|---|---|
| 5,627,938 | A | 5/1997 | Johnston | |
| 5,734,792 | A | 3/1998 | Teh | 704/230 |
| 5,752,225 | A * | 5/1998 | Fielder | 704/229 |
| 5,774,842 | A | 6/1998 | Nishio et al. | 704/226 |
| 6,578,162 | B1 | 6/2003 | Yung | 714/708 |
| 6,704,705 | B1 | 3/2004 | Kabal et al. | 704/230 |
| 6,772,111 | B2 | 8/2004 | Araki | 704/200.1 |
| 7,272,566 | B2 | 9/2007 | Vinton | 704/500 |
| 7,305,346 | B2 | 12/2007 | Oyama et al. | 704/503 |
| RE40,280 | E | 4/2008 | Johnston | 704/200.1 |
| 7,454,327 | B1 * | 11/2008 | Neubauer et al. | 704/200.1 |
| 7,565,296 | B2 | 7/2009 | Oh | 704/273 |
| 7,668,715 | B1 * | 2/2010 | Chaugule et al. | 704/230 |
| 7,873,510 | B2 | 1/2011 | Kurniawati et al. | 704/200.1 |
| 2003/0212551 | A1 * | 11/2003 | Rose et al. | 704/230 |
| 2004/0131204 | A1 * | 7/2004 | Vinton | 381/98 |
| 2006/0004565 | A1 * | 1/2006 | Eguchi | 704/200.1 |
| 2007/0016427 | A1 | 1/2007 | Thumpudi et al. | 704/500 |
| 2007/0033022 | A1 * | 2/2007 | Ouyang et al. | 704/229 |
| 2007/0162277 | A1 * | 7/2007 | Kurniawati et al. | 704/200.1 |
| 2007/0233474 | A1 | 10/2007 | Song | 704/219 |
| 2011/0035212 | A1 * | 2/2011 | Briand et al. | 704/203 |

FOREIGN PATENT DOCUMENTS

| | | | |
|---|---|---|---|
| EP | 1139336 | A2 | 10/2001 |
| EP | 1367566 | A2 | 12/2003 |
| EP | 1517324 | A2 | 3/2005 |
| JP | 2003280695 | A | 10/2003 |
| JP | 2004341384 | A | 12/2004 |

OTHER PUBLICATIONS

Office Action issued in corresponding Japanese patent application No. 2010-522867 on Jul. 12, 2013, 2 pages.

* cited by examiner

TRANSFORM CODING OF SPEECH AND AUDIO SIGNALS

CROSS-REFERENCE TO RELATED APPLICATIONS

This application is a continuation of U.S. application Ser. no. 12/674117, having a 371 date of Sep. 8, 2010 (published as US 20110035212) (now abandoned), which is 35 U.S.C. §371 National Phase Application of PCT/SE2008/050967, filed Aug. 26, 2008 (published as WO 2009/029035), which claims priority to: i) U.S. application Ser. no. 60/968,159, filed Aug. 27, 2007; and ii) U.S. application Ser. no. 61/044,248, filed Apr. 11, 2008. The above-mentioned applications and publications are incorporated by reference herein

TECHNICAL FIELD

The present invention generally relates to signal processing such as signal compression and audio coding, and more particularly to improved transform speech and audio coding and corresponding devices.

BACKGROUND

An encoder is a device, circuitry, or computer program that is capable of analyzing a signal such as an audio signal and outputting a signal in an encoded form. The resulting signal is often used for transmission, storage, and/or encryption purposes. On the other hand, a decoder is a device, circuitry, or computer program that is capable of inverting the encoder operation, in that it receives the encoded signal and outputs a decoded signal.

In most state-of-the-art encoders such as audio encoders, each frame of the input signal is analyzed and transformed from the time domain to the frequency domain. The result of this analysis is quantized and encoded and then transmitted or stored depending on the application. At the receiving side (or when using the stored encoded signal) a corresponding decoding procedure followed by a synthesis procedure makes it possible to restore the signal in the time domain.

Codecs (encoder-decoder) are often employed for compression/decompression of information such as audio and video data for efficient transmission over bandwidth-limited communication channels.

So called transform coders or more generally, transform codecs are normally based around a time-to-frequency domain transform such as a DCT (Discrete Cosine Transform), a Modified Discrete Cosine Transform (MDCT) or some other lapped transform which allow a better coding efficiency relative to the hearing system properties. A common characteristic of transform codecs is that they operate on overlapped blocks of samples i.e. overlapped frames. The coding coefficients resulting from a transform analysis or an equivalent sub-band analysis of each frame are normally quantized and stored or transmitted to the receiving side as a bit-stream. The decoder, upon reception of the bit-stream, performs de-quantization and inverse transformation in order to reconstruct the signal frames.

So-called perceptual encoders use a lossy coding model for the receiving destination i.e. the human auditory system, rather than a model of the source signal. Perceptual audio encoding thus entails the encoding of audio signals, incorporating psychoacoustical knowledge of the auditory system, in order to optimize/reduce the amount of bits necessary to reproduce faithfully the original audio signal. In addition, perceptual encoding attempts to remove i.e. not transmit or approximate parts of the signal that the human recipient would not perceive, i.e. lossy coding as opposed to lossless coding of the source signal. The model is typically referred to as the psychoacoustical model. In general, perceptual coders will have a lower signal to noise ratio (SNR) than a waveform coder will, and a higher perceived quality than a lossless coder operating at equivalent bit rate.

A perceptual encoder uses a masking pattern of stimulus to determine the least number of bits necessary to encode i.e. quantize each frequency sub-band, without introducing audible quantization noise.

Existing perceptual coders operating in the frequency domain usually use a combination of the so-called Absolute Threshold of Hearing (ATH) and both tonal and noise-like spreading of masking in order to compute the so-called Masking Threshold (MT) [1]. Based on this instantaneous masking threshold, existing psychoacoustical models compute scale factors which are used to shape the original spectrum so that the coding noise is masked by high energy level components e.g. the noise introduced by the coder is inaudible [2].

Perceptual modeling has been extensively used in high bit rate audio coding. Standardized coders, such as MPEG-1 Layer III [3], MPEG-2 Advanced Audio Coding [4], achieve "CD quality" at rates of 128 kbps and respectively 64 kbps for wideband audio. Nevertheless, these codecs are by definition forced to underestimate the amount of masking to ensure that distortion remains inaudible. Moreover, wideband audio coders usually use a high complexity auditory (psychoacoustical) model, which is not very reliable at low bit rate (below 64 kbps).

SUMMARY

Due to the aforementioned problems, there is a need for an improved psychoacoustic model reliable at low bit rates while maintaining a low complexity functionality.

The present invention overcomes these and other drawbacks of the prior art arrangements.

A method of perceptual transform coding of audio signals in a telecommunication system according to some embodiments includes the following steps:(a) initially determining transform coefficients representative of a time to frequency transformation of a time segmented input audio signal, (b) determining a spectrum of perceptual sub-bands for the input audio signal based on the determined transform coefficients, (c) determining masking thresholds for each of the sub-bands based on said determined spectrum, (d) computing scale factors for each sub-band based on its respective determined masking thresholds, and (e) adapting the computed scale factors for each of the sub-bands to prevent energy loss due to coding for perceptually relevant sub-bands, i.e. in order to reach high quality low bit rate coding.

Further advantages offered by the invention will be appreciated when reading the below description of embodiments of the invention.

BRIEF DESCRIPTION OF THE DRAWINGS

The invention, together with further objects and advantages thereof, may best be understood by referring to the following description taken together with the accompanying drawings, in which.

ABBREVIATIONS

ATH Absolute Threshold of Hearing
BS Bark Spectrum
DCT Discrete Cosine Transform
DFT Discrete Fourier Transform
ERB Equivalent Rectangular Bandwidth
IMDCT Inverse Modified Discrete Cosine Transform
MT Masking Threshold
MDCT Modified Discrete Cosine Transform
SF Scale Factor

DETAILED DESCRIPTION

The present invention is mainly concerned with transform coding, and specifically with sub-band coding.

To simplify the understanding of the following description of embodiments of the present invention, some key definitions will be described below.

Signal processing in telecommunication, sometimes utilizes companding as a method of improving the signal representation with limited dynamic range. The term is a combination of compressing and expanding, thus indicating that the dynamic range of a signal is compressed before transmission and is expanded to the original value at the receiver. This allows signals with a large dynamic range to be transmitted over facilities that have a smaller dynamic range capability.

In the following, the invention will be described in relation to a specific exemplary and non-limiting codec realization suitable for the ITU-T G.722.1 full-band codec extension, now renamed ITU-T G.719. In this particular example, the codec is presented as a low-complexity transform-based audio codec, which preferably operates at a sampling rate of 48 kHz and offers full audio bandwidth ranging from 20 Hz up to 20 kHz. The encoder processes input 16-bits linear PCM signals on frames of 20 ms and the codec has an overall delay of 40 ms. The coding algorithm is preferably based on transform coding with adaptive time-resolution, adaptive bit-allocation and low-complexity lattice vector quantization. In addition, the decoder may replace non-coded spectrum components by either signal adaptive noise-fill or bandwidth extension.

Figure 1:
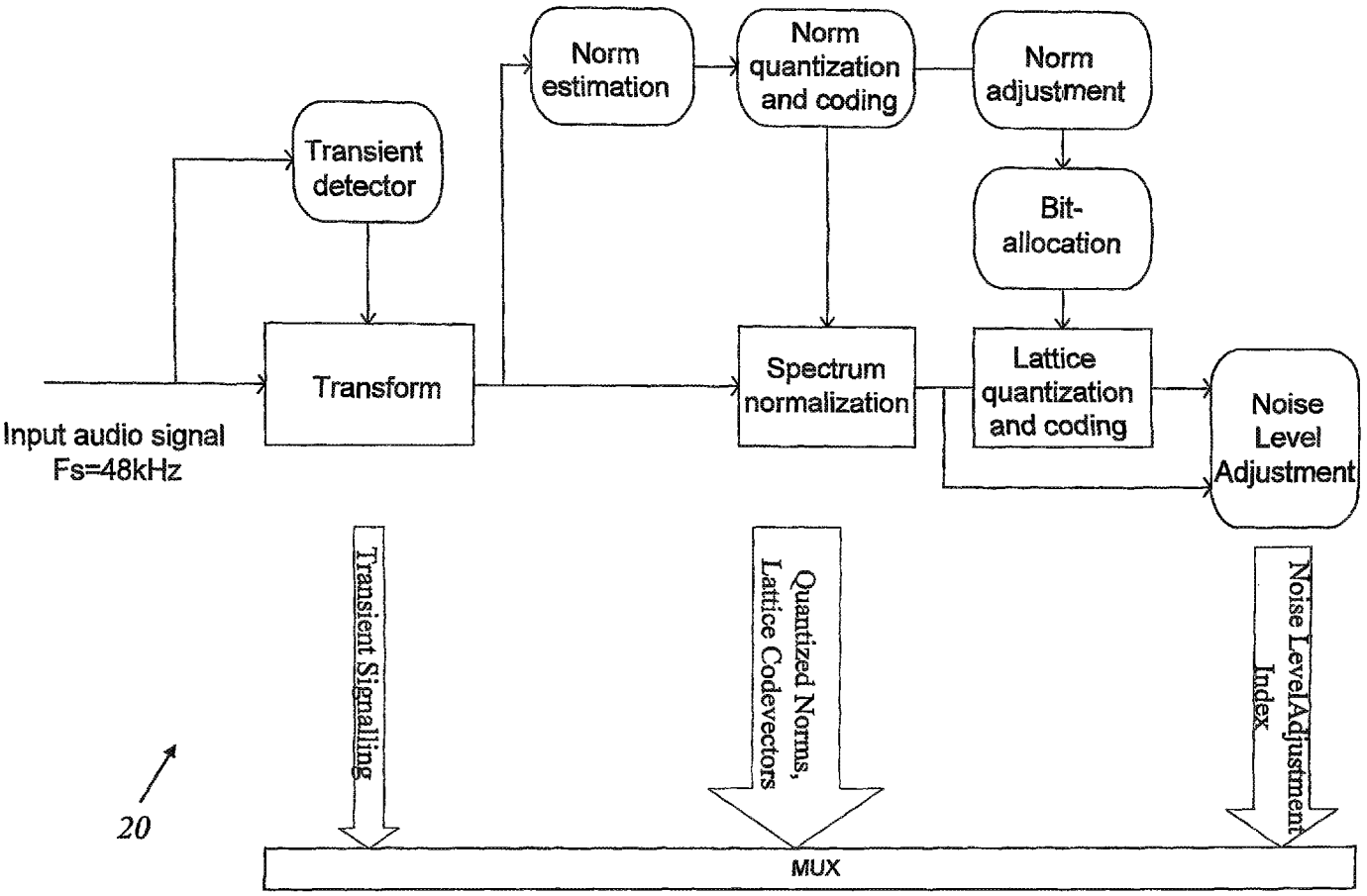
FIG. 1 illustrates exemplary encoder suitable for full-band audio encoding.

FIG. 1 is a block diagram of an exemplary encoder suitable for full-band audio encoding. The input signal sampled at 48 kHz is processed through a transient detector. Depending on the detection of a transient, a high frequency resolution or a low frequency resolution (high time resolution) transform is applied on the input signal frame. The adaptive transform is preferably based on a Modified Discrete Cosine Transform (MDCT) in case of stationary frames. For non-stationary frames, a higher temporal resolution transform is used without a need for additional delay and with very little overhead in complexity. Non-stationary frames preferably have a temporal resolution equivalent to 5 ms frames (although any arbitrary resolution can be selected).

It may be beneficial to group the obtained spectral coefficients into bands of unequal lengths. The norm of each band may be estimated and the resulting spectral envelope consisting of the norms of all bands is quantized and encoded. The coefficients are then normalized by the quantized norms. The quantized norms are further adjusted based on adaptive spectral weighting and used as input for bit allocation. The normalized spectral coefficients are lattice vector quantized and encoded based on the allocated bits for each frequency band. The level of the non-coded spectral coefficients is estimated, coded and transmitted to the decoder. Huffman encoding is preferably applied to quantization indices for both the coded spectral coefficients as well as the encoded norms.

Figure 2:
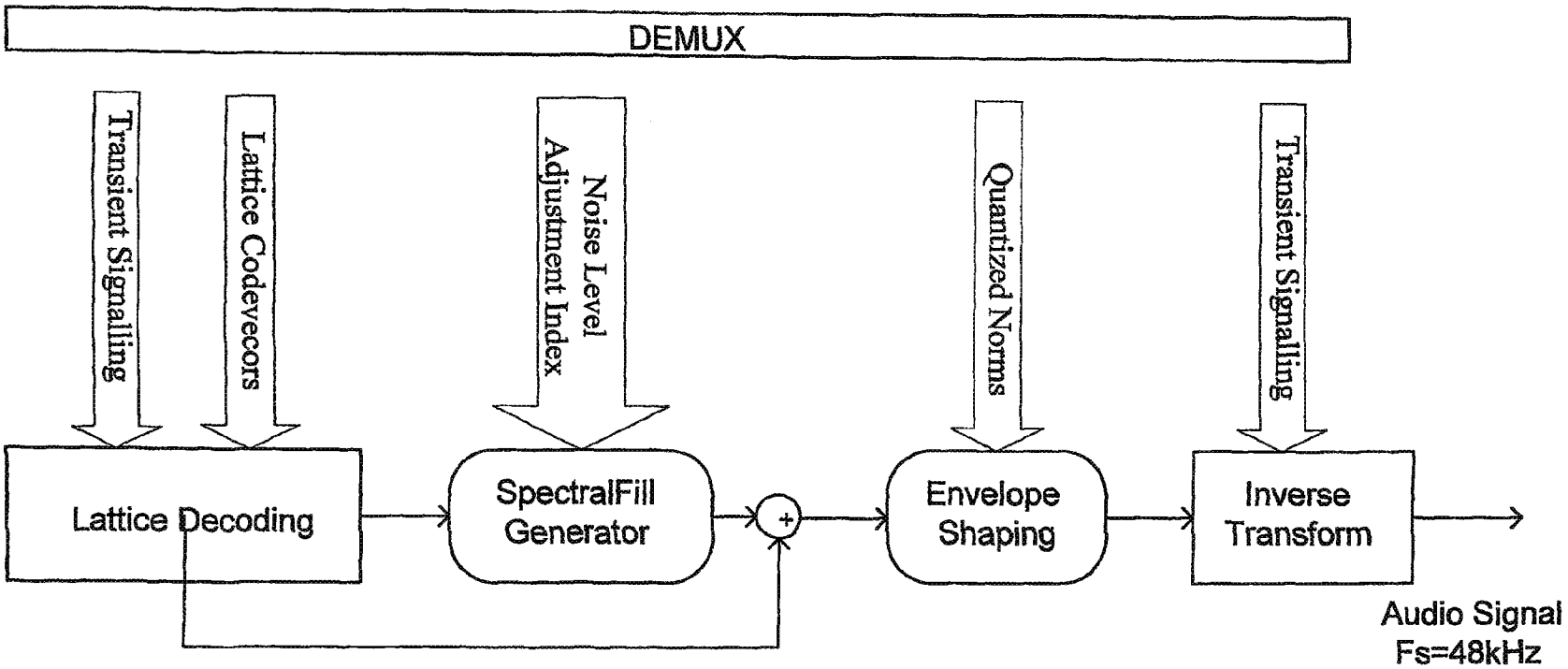
FIG. 2 illustrates an exemplary decoder suitable for full-band audio decoding.

FIG. 2 is a block diagram of an exemplary decoder suitable for full-band audio decoding. The transient flag is first decoded which indicates the frame configuration, i.e. stationary or transient. The spectral envelope is decoded and the same, bit-exact, norm adjustments and bit-allocation algorithms are used at the decoder to re-compute the bit-allocation, which is essential for decoding quantization indices of the normalized transform coefficients.

After de-quantization, low frequency non-coded spectral coefficients (allocated zero bits) are regenerated, preferably by using a spectral-fill codebook built from the received spectral coefficients (spectral coefficients with non-zero bit allocation).

Noise level adjustment index may be used to adjust the level of the regenerated coefficients. High frequency non-coded spectral coefficients are preferably regenerated using bandwidth extension.

The decoded spectral coefficients and regenerated spectral coefficients are mixed and lead to a normalized spectrum. The decoded spectral envelope is applied leading to the decoded full-band spectrum.

Finally, the inverse transform is applied to recover the time-domain decoded signal. This is preferably performed by applying either the Inverse Modified Discrete Cosine Transform (IMDCT) for stationary modes, or the inverse of the higher temporal resolution transform for transient mode.

The algorithm adapted for full-band extension is based on adaptive transform-coding technology. It operates on 20 ms frames of input and output audio. Because the transform window (basis function length) is of 40 ms and a 50 percent overlap is used between successive input and output frames, the effective look-ahead buffer size is 20 ms. Hence, the overall algorithmic delay is of 40 ms which is the sum of the frame size plus the look-ahead size. All other additional delays experienced in use of a G.722.1 full-band codec (ITU-T G.719) are either due to computational and/or network transmission delays.

Figure 3:
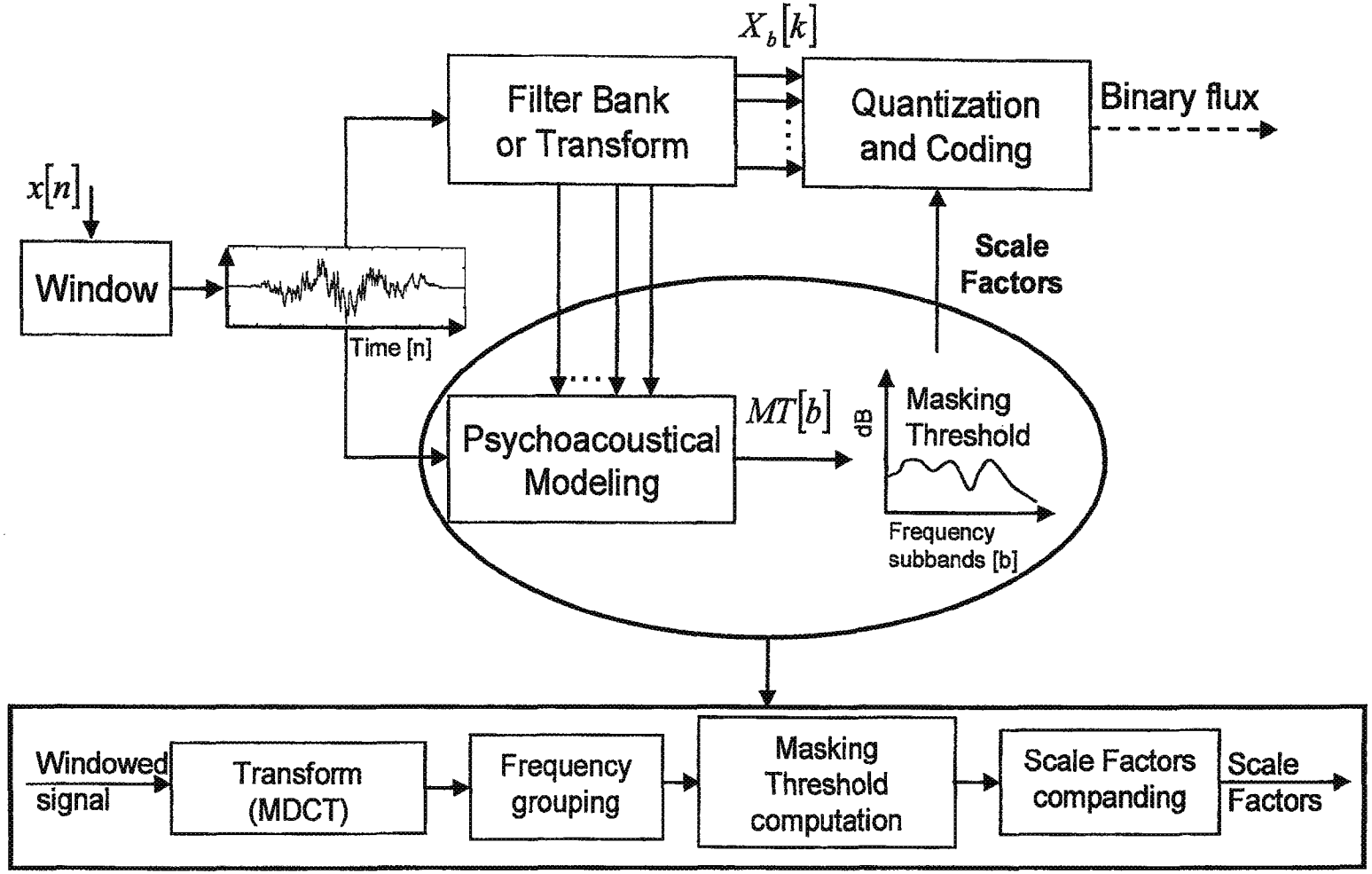
FIG. 3 illustrates a generic perceptual transform encoder.
Figure 4:
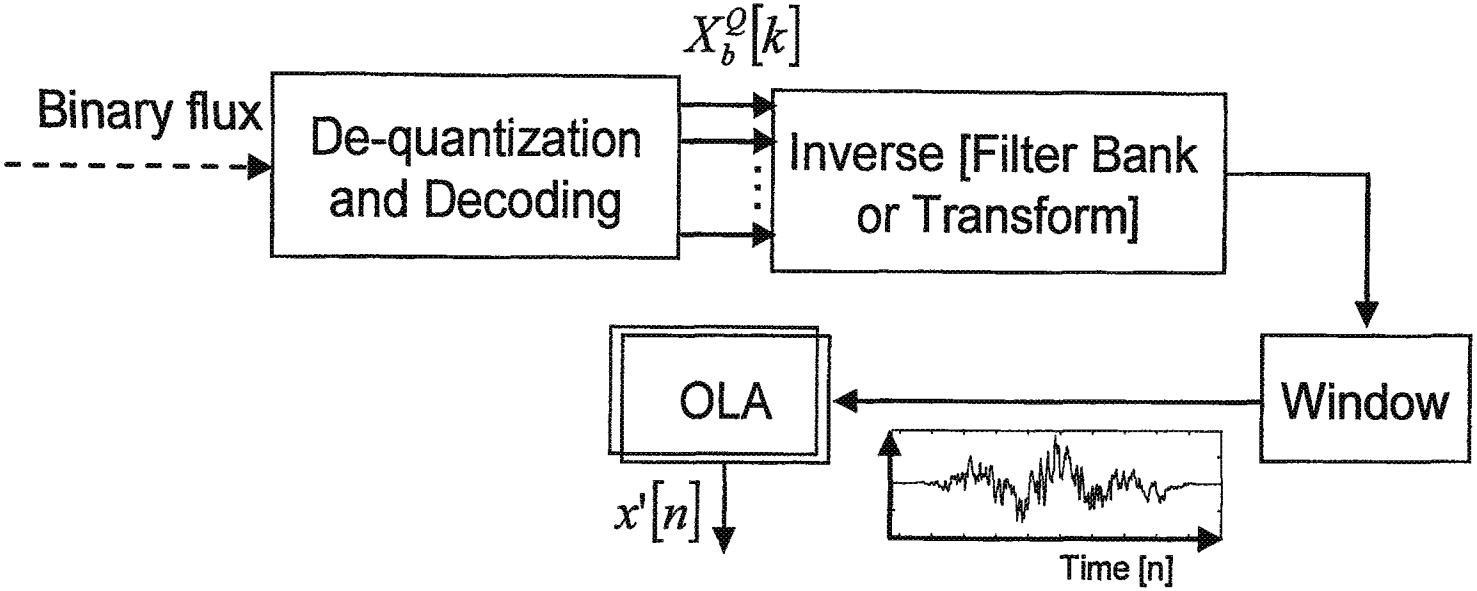
FIG. 4 illustrates a generic perceptual transform decoder.

A general and typical coding scheme relative to a perceptual transform coder will be described with reference to FIG. 3. The corresponding decoding scheme will be presented with reference to FIG. 4.

The first step of the coding scheme or process consists of a time-domain processing usually called windowing of the signal, which results in a time segmentation of an input audio signal.

The time to frequency domain transform used by the codec (both coder and decoder) could be, for example: Discrete Fourier Transform (DFT), according to Equation 1, $$X[k] = \sum_{n=0}^{N-1} w[n] \times x[n] \times e^{-j2\pi\frac{nk}{N}},\ k \in \left[0, \ldots, \frac{N}{2} - 1\right], \tag{1}$$

where X[k] is the DFT of the windowed input signal x[n]. N is the size of the window w[n], n is the time index and k the frequency bin index, Discrete Cosine Transform (DCT), Modified Discrete Cosine Transform (MDCT), according to Equation 2, $$X[k] = \sum_{n=0}^{2N-1} w[n] \times x[n] \times \cos\left[\frac{\pi}{N}\left(n + \frac{N+1}{2}\right)\left(k + \frac{1}{2}\right)\right], \quad k \in [0, \ldots, N-1], \tag{2}$$

where X[k] is the MDCT of a windowed input signal x[n] N is the size of the window w[n], n is the time index and k the frequency bin index.

Based on any one of these frequency representations of the input audio signal, a perceptual audio codec aims at decomposing the spectrum, or its approximation, regarding the critical bands of the auditory systems e.g. the so-called Bark scale, or an approximation of the Bark scale, or some other frequency scale. For further understanding, the Bark scale is a standardized scale of frequency, where each "Bark" (named after Barkhausen) constitutes one critical bandwidth.

This step can be achieved by a frequency grouping of the transform coefficients according to a perceptual scale established according to the critical bands, see Equation 3.

$$X_b[k] = \{X[k]\}, k \in [k_b, \ldots, k_{b+1}-1], b \in [1, \ldots N_b], \tag{3}$$

where $N_b$ is the number of frequency or psychoacoustical bands, k the frequency bin index, and b is a relative index.

As stated previously, a perceptual transform codec relies on the estimation of the Masking Threshold MT[b] in order to derive a frequency shaping function e.g. the Scale Factors SF[b], applied to the transform coefficients $X_b[k]$ in the psychoacoustical sub-band domain. The scaled spectrum $Xs_b[k]$ can be defined according to Equation 4 below $$Xs_b[k] = X_b[k] \times \mathrm{MT}[b], k \in [k_b, \ldots, k_{b+1}-1], \quad b \in [1, \ldots, N_b] \tag{4}$$

where $N_b$ is the number of frequency or psychoacoustical bands, k the frequency bin index, and b is a relative index.

Finally, the perceptual coder can then exploit the perceptually scaled spectrum for coding purpose. As it is showed in the FIG. 3, a quantization and coding process can perform the redundancy reduction, which will be able to focus on the most perceptually relevant coefficients of the original spectrum by using the scaled spectrum.

At the decoding stage (see FIG. 4) the inverse operation is achieved by using the de-quantization and decoding of the received binary flux e.g. bitstream. This step is followed by the inverse Transform (Inverse MDCT-IMDCT or inverse DFT-IDFT, etc.) to get the signal back to the time domain. Finally, the overlap-add method is used to generate the perceptually reconstructed audio signal, i.e. lossy coding since only the perceptually relevant coefficients are decoded.

In order to take into account the auditory system limitations, the invention performs a suitable frequency processing which allows the scaling of transform coefficients so that the coding does not modify the final perception.

Consequently, the present invention enables the psychoacoustical modeling to meet the requirements of very low complexity applications. This is achieved by using straightforward and simplified computation of the scale factors. Subsequently, an adaptive companding/expanding of the scale factors allows low bit rate fullband audio coding with high perceptual audio quality. In summary, the technique of the present invention enables perceptually optimizing the bit allocation of the quantizer such that all perceptually relevant coefficients are quantized independently of the original signal or spectrum dynamics range.

Below, embodiments of methods and arrangements for psychoacoustical model improvements according to the present invention will be described.

In the following, the details of the psychoacoustical modelling used to derive the scale factors which can be used for an efficient perceptual coding will be described.

Figure 5:
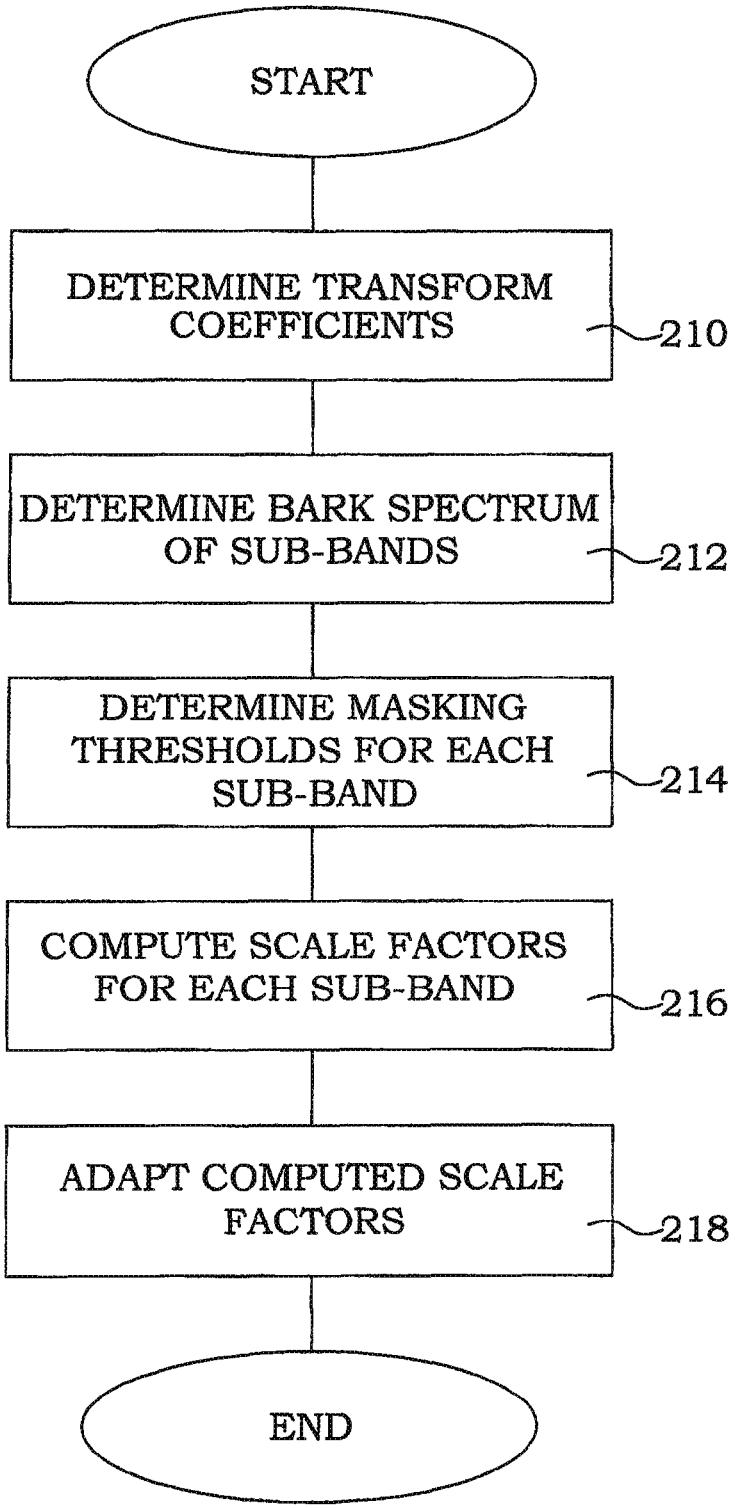
FIG. 5 illustrates a flow diagram of a method in a psychoacoustical model according to the present invention.

With reference to FIG. 5, a general embodiment of a method according to the present invention will be described. Basically, an audio signal e.g. a speech signal is provided for encoding. It is processed according to standard procedures, as described previously, thus resulting in a windowed and time segmented input audio signal. Transform coefficients are initially determined in step 210 for the thus time segmented input audio signal. Subsequently, perceptually grouped coefficients or perceptual frequency sub-bands are determined in step 212, e.g. according to the Bark scale or some other scale. For each such determined coefficient or sub-band, a masking threshold is determined in step 214. In addition, scale factors are computed for each sub-band or coefficient in step 216. Finally, the thus computed scale factors are adapted in step 218 to prevent energy loss due to encoding for the perceptually relevant sub-bands, i.e. the sub-bands that actually affect the listening experience at a receiving person or apparatus.

This adaptation will therefore maintain the energy of the relevant sub-bands and therefore will maximize the perceived quality of the decoded audio signal.

Figure 6:
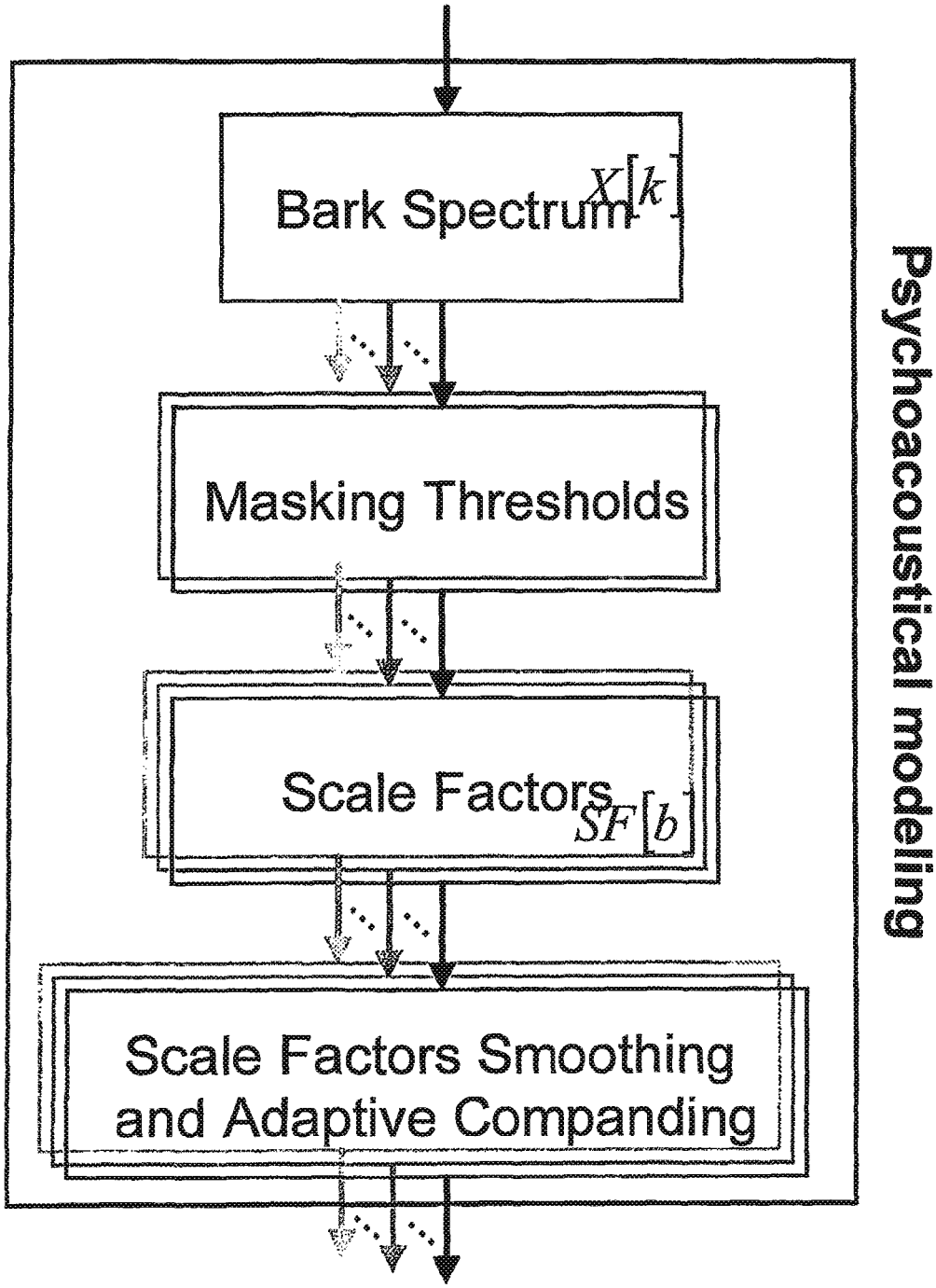
FIG. 6 illustrates a further flow diagram of an embodiment of a method according to the present invention.

With reference to FIG. 6, a further specific embodiment of a psychoacoustical model according to the present invention will be described. The embodiment enables the computations of Scale Factors, SF[b] for each psychoacoustical sub-band, b, defined by the model. Although the embodiment is described with emphasis on the so called Bark scale, it is with only minor adjustment equally applicable to any suitable perceptual scale. Without loss of generality, consider a high frequency resolution for the low frequencies (groups of few transform coefficients) and inversely for the high frequencies. The number of coefficients per sub-band can be defined by a perceptual scale, for example the Equivalent Rectangular Bandwidth (ERB) that is considered as a good approximation of the so-called Bark scale, or by the frequency resolution of the quantizer used afterwards. An alternative solution can be to use a combination of the two depending on the coding scheme used.

With the transform coefficients X[k] as input, the psychoacoustical analysis firstly compute the Bark Spectrum BS[b] (in dB) defined according to Equation 5:

$$BS[b] = 10 \times \log_{10}\left(\sum_{k=k_b}^{k_{b+1}-1} |X[k]|^2\right), b \in [1, \ldots, N_b] \tag{5}$$

where $N_b$ is the number of psychoacoustical sub-bands, k the frequency bin index, and b is a relative index.

Based on the determination of the perceptual coefficients or critical sub-bands e.g. Bark Spectrum, the psychoacoustical model according to the present invention performs the aforementioned low-complexity computation of the Masking Thresholds MT.

The first step consists in deriving the Masking Thresholds MT from the Bark Spectrum by considering an average masking. No difference is made between tonal and noisy components in the audio signal. This is achieved by an energy decrease of 29 dB for each sub-band b, see Equation 6 below, $$MT[b]=BS[b]-29, b\epsilon[1, \ldots, N_b] \quad (6).$$

The second step relies on the spreading effect of frequency masking described in [2]. The psychoacoustical model, hereby presented, takes into account both forward and backward spreading within a simplified equation as defined by the following $$\begin{cases} MT[b] = \max(MT[b], MT[b-1]-12.5), b \in [2, \ldots, N_b] \\ MT[b] = \max(MT[b], MT[b+1]-25), b \in [1, \ldots, N_b-1]. \end{cases} \quad (7)$$

The final step delivers a Masking Threshold for each sub-band by saturating the previous values with the so called Absolute Threshold of Hearing ATH as defined by Equation 8

$$MT[b]=\max(ATH[b], MT[b]), b\epsilon[1, \ldots, N_b] \quad (8).$$

The ATH is commonly defined as the volume level at which a subject can detect a particular sound 50% of the time. From the computed Masking Thresholds MT, the proposed low-complexity model of the present invention aims at computing the Scale Factors, SF[b], for each psychoacoustical sub-band. The SF computation relies both on a normalization step, and on an adaptive companding/expanding step.

Based on the fact that the transform coefficients are grouped according to a non-linear scale (larger bandwidth for the high frequencies), the accumulated energy in all sub-bands for the MT computation may be normalized after application of the spreading of masking. The normalization step can be written as Equation 9

$$MT_{norm}[b]=MT[b]-10\times\log_{10}(L[N_b]), b\epsilon[1, \ldots, N_b] \quad (9),$$

where $L[1, \ldots, N_b]$ are the length (number of transform coefficients) of each psychoacoustical sub-band b.

The Scale Factors SF are then derived from the normalized Masking Thresholds with the assumption that the normalized MT, $MT_{norm}$ are equivalents to the level of coding noise, which can be introduced by the considered coding scheme. Then we define the Scale Factors SF[b] as the opposite of the $MT_{norm}$ values according to Equation 10.

$$SF[b]=-MT_{norm}[b], b\epsilon[1, \ldots, N_b] \quad (10).$$

Then, the values of the Scale Factors are reduced so that the effect of masking is limited to a predetermined amount. The model can foresee a variable (adaptively to the bit rate) or fix dynamic range of the Scale Factors to a=20 dB:

$$SF[b] = \alpha \times \frac{(SF[b]-\min(SF))}{(\max(SF)-\min(SF))}, b \in [1, \ldots, N_b] \quad (11)$$

It is also possible to link this dynamic value to the available data rate. Then, in order to make the quantizer focus on the low frequency components, the Scale Factors can be adjusted so that no energy loss can appear for perceptually relevant sub-bands. Typically, low SF values (lower than 6 dB) for the lowest sub-bands (frequencies below 500 Hz) are increased so that they will be considered by the coding scheme as perceptually relevant.

Figure 7:
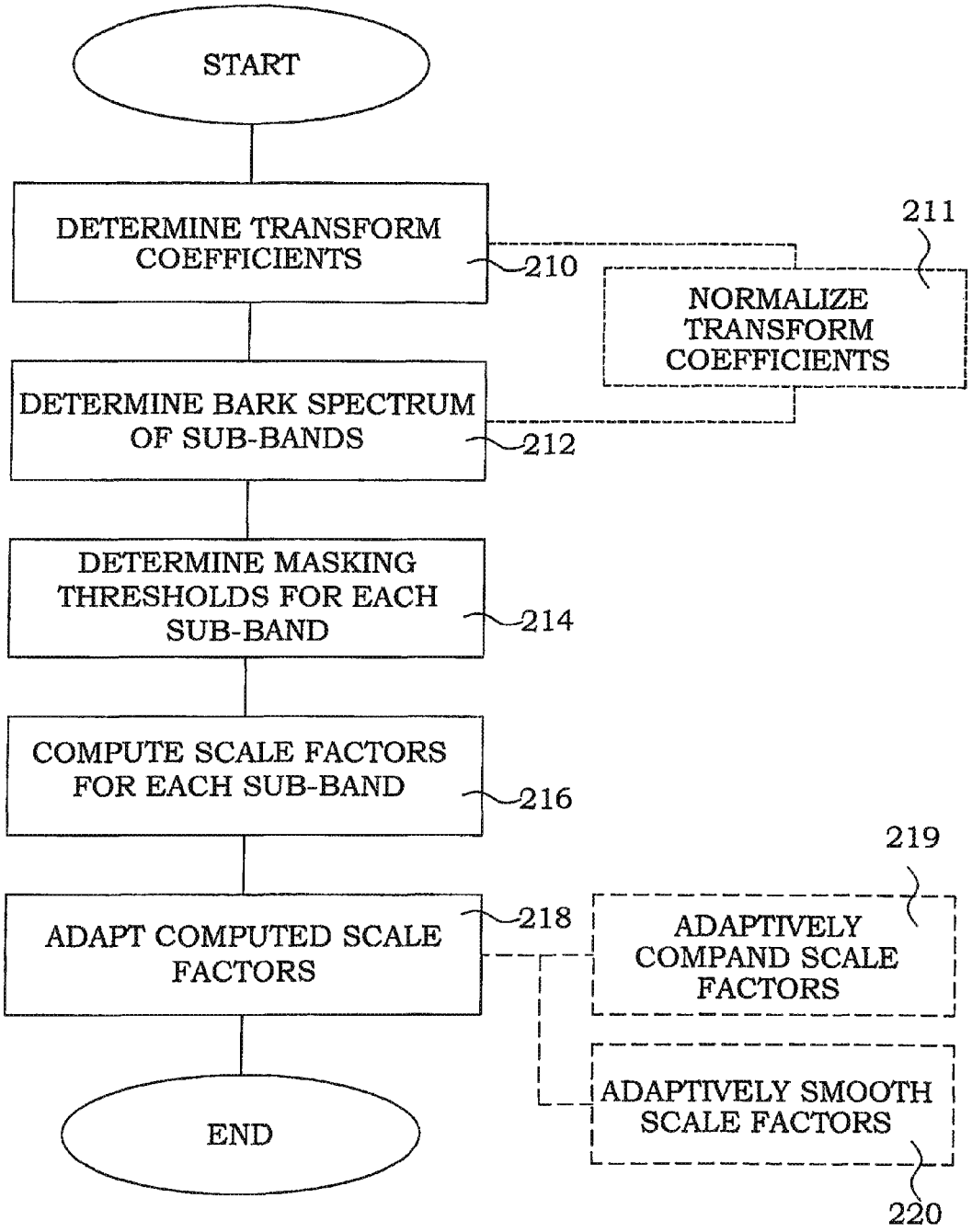
FIG. 7 illustrates another flow diagram of an embodiment of a method according to the present invention.

With reference to FIG. 7 a further embodiment will be described. The same steps as described with reference to FIG. 5 are present. In addition, the determined transform coefficients from step 210 are normalized in step 211, before being used to determine the perceptual coefficients or sub-bands in step 212. Further, the step 218 of adapting the scale factors is further comprising a step 219 of adaptively companding the scale factors, and the step 220 of adaptively smoothing the scale factors. These two steps 219, 220 can naturally be included in the embodiments of FIGS. 5 and 6 as well.

According to this embodiment, the method according to the invention additionally performs a suitable mapping of the spectral information to the quantizer range used by the transform-domain codec. The dynamics of the input spectral norms are adaptively mapped to the quantizer range in order to optimize the coding of the signal dominant parts. This is achieved by computing a weighted function, which is able to either compand, or expand the original spectral norms to the quantizer range. This enables full-band audio coding with high audio quality at several data rates (medium and low rates) without modifying the final perception. One strong advantage of the invention is also the low complexity computation of the weighted function in order to meet the requirements of very low complexity (and low delay) applications.

According to the embodiment, the signal to map to the quantizer corresponds to the norm (root mean-square) of the input signal in a transformed spectral domain (e.g. frequency domain). The sub-band frequency decomposition (sub-band boundaries) of these norms (sub-bands with index p) has to map to the quantizer frequency resolution (sub-bands with index b). The norms are then level adjusted and a dominant norm is computed for each sub-band b according to the neighbor norms (forward and backward smoothed) and an absolute minimum energy. The details of the operation are described in the following.

Initially, the norms (Spe(p)) are mapped to the spectral domain. This is performed according to the following linear operation, see Equation 12

$$BSpe(b) = \frac{1}{H_b}\sum_{p\in J_b} Spe(p) + T_b, b = 0, \ldots, B_{MAX}-1, \quad (12)$$

where $B_{MAX}$ is the maximum number of sub-bands (20 for this specific implementation). The values of $H_b$, $T_b$ and $J_b$ are defined in the Table 1 which is based on a quantizer using 44 spectral sub-bands. $J_b$ is a summation interval which corresponds to the transformed domain sub-band numbers.

TABLE 1

Spectrum mapping constant

| b | $J_b$ | $H_b$ | $T_b$ | A(b) |
|---|---|---|---|---|
| 0 | 0 | 1 | 3 | 8 |
| 1 | 1 | 1 | 3 | 6 |
| 2 | 2 | 1 | 3 | 3 |
| 3 | 3 | 1 | 3 | 3 |
| 4 | 4 | 1 | 3 | 3 |
| 5 | 5 | 1 | 3 | 3 |
| 6 | 6 | 1 | 3 | 3 |
| 7 | 7 | 1 | 3 | 3 |
| 8 | 8 | 1 | 3 | 3 |
| 9 | 9 | 1 | 3 | 3 |
| 10 | 10, 11 | 2 | 4 | 3 |
| 11 | 12, 13 | 2 | 4 | 3 |
| 12 | 14, 15 | 2 | 4 | 3 |
| 13 | 16, 17 | 2 | 5 | 3 |
| 14 | 18, 19 | 2 | 5 | 3 |
| 15 | 20, 21, 22, 23 | 4 | 6 | 3 |
| 16 | 24, 25, 26 | 3 | 6 | 4 |
| 17 | 27, 28, 29 | 3 | 6 | 5 |
| 18 | 30, 31, 32, 33, 34 | 5 | 7 | 7 |
| 19 | 35, 36, 37, 38, 39, 40, 41, 42, 43 | 9 | 8 | 11 |

The mapped spectrum BSpe(b) is forward smoothed according to Equation 13

$$BSpe(b)=\max(BSpe(b),BSpe(b-1)-4),b=1 \ldots ,B_{MAX}, \quad (13)$$

and backward smoothed according to Equation 14 below $$BSpe(b)=\max(BSpe(b),BSpe(b+1)-4), \quad b=B_{MAX}-1, \ldots ,0 \quad (14)$$

The resulting function is thresholded and renormalized according to Equation 15

$$BSpe(b)=T(b)-\max(BSpe(b),A(b)),b=0, \ldots ,B_{MAX}-1 \quad (15)$$

where A(b) is given by Table 1. The resulting function, Equation 16 below, is further adaptively companded or expanded depending on the dynamic range of the spectrum (a=4 in this specific implementation)

$$BSpe(b) = \frac{\alpha}{\max\{BSpe(b)\} - \min\{BSpe(b)\}}[BSpe(b) - \min\{BSpe(b)\}] \quad (16)$$

According to the dynamics of the signal (min and max) the weighting function is computed such that it compands the signal if its dynamics exceed the quantizer range, and extends the signal if its dynamics does not cover the full range of the quantizer.

Finally, by using the inverse sub-band domain mapping (based on the original boundaries in the transformed domain), the weighting function is applied to the original norms to generate the weighted norms which will feed the quantizer.

Figure 8:
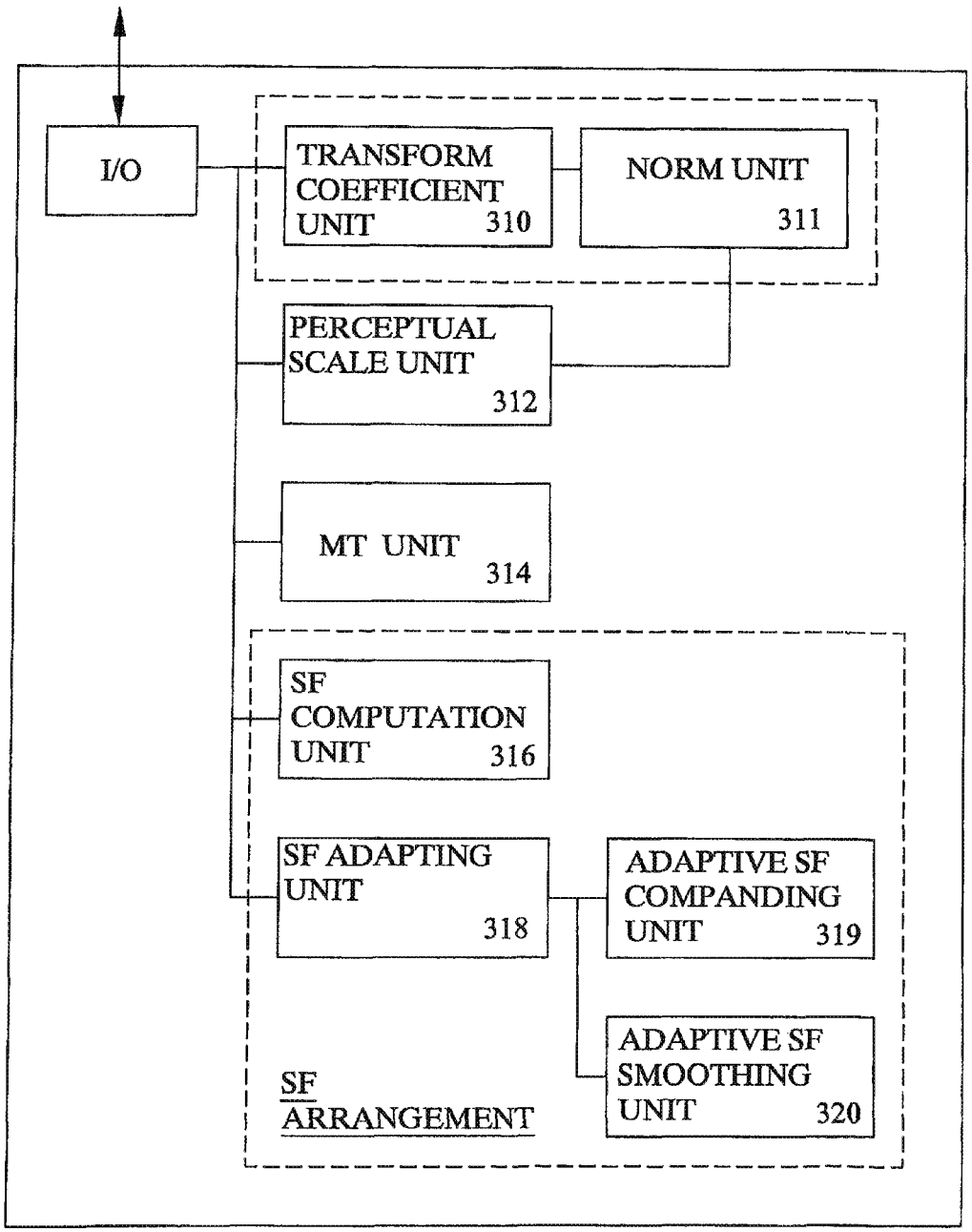
FIG. 8 illustrates an arrangement according to some embodiments for performing methods disclosed herein.

An embodiment of an arrangement for enabling the embodiments of the method of the present invention will be described with reference to FIG. 8. The arrangement comprises an input/output unit I/O for transmitting and receiving audio signals or representations of audio signals for processing. In addition the arrangement comprises transform determining means 310 adapted to determine transform coefficients representative of a time to frequency transformation of a received time segmented input audio signal, or representation of such audio signal. According to a further embodiment the transform determination unit can be adapted to or connected to a norm unit 311 adapted for normalizing the determined coefficients. This is indicated by the dotted line in FIG. 8. Further, the arrangement comprises a unit 312 for determining a spectrum of perceptual sub-bands for the input audio signal, or representation thereof, based on the determined transform coefficients, or normalized transform coefficients. A masking unit 314 is provided for determining masking thresholds MT for each said sub-band based on said determined spectrum. Finally, the arrangement comprises a unit 316 for computing scale factors for each said sub-band based on said determined masking thresholds. This unit 316 can be provided with or be connected to adapting means 318 for adapting said computed scale factors for each said sub-band to prevent energy loss for perceptually relevant sub-bands. For a specific embodiment, the adapting unit 318 comprises a unit 319 for adaptively companding the determined scale factors, and a unit 320 for adaptively smoothing the determined scale factors.

The above described arrangement can be included in or be connectable to an encoder or encoder arrangement in a telecommunication system.

Advantages of the present invention comprise: low complexity computation with high quality fullband audio flexible frequency resolution adapted to the quantizer adaptive companding/expanding of the scale factors.

It will be understood by those skilled in the art that various modifications and changes may be made to the present invention without departure from the scope thereof, which is defined by the appended claims.

REFERENCES

[1] J. D. Johnston, "Estimation of Perceptual Entropy Using Noise Masking Criteria", Proc. ICASSP, pp. 2524-2527, Mai 1988.

[2] J. D. Johnston, "Transform coding of audio signals using perceptual noise criteria", IEEE J. Select. Areas Commun., vol. 6, pp. 314-323, 1988.

[3] ISO/IEC JTC/SC29/WG 11, CD 11172-3, "Coding of Moving Pictures and Associated Audio for Digital Storage Media at up to about 1.5 MBIT/s, Part 3 AUDIO", 1993.

[4] ISO/IEC 13818-7, "MPEG-2 Advanced Audio Coding, AAC", 1997.

The invention claimed is:

1. A method for use in transform coding, comprising:

obtaining an audio signal;

obtaining a spectrum (Spe(p)) corresponding to at least a portion of said audio signal;

mapping Spe(p) to a spectrum of perceptual sub-bands according to the following linear $$BSpe(b) = \frac{1}{Hb}\sum_{p \in J_b} Spe(p) + T_b,\ b = 0, \ldots , B_{MAX} - 1,$$

operation: where Bmax is an integer value not greater than 20 and the values of $H_b$, $T_b$ and $J_b$ are defined in table 1 as:

TABLE 1

Spectrum mapping constant

| b | $J_b$ | $H_b$ | $T_b$ |
|---|---|---|---|
| 0 | 0 | 1 | 3 |
| 1 | 1 | 1 | 3 |
| 2 | 2 | 1 | 3 |
| 3 | 3 | 1 | 3 |
| 4 | 4 | 1 | 3 |
| 5 | 5 | 1 | 3 |
| 6 | 6 | 1 | 3 |
| 7 | 7 | 1 | 3 |
| 8 | 8 | 1 | 3 |
| 9 | 9 | 1 | 3 |
| 10 | 10, 11 | 2 | 4 |
| 11 | 12, 13 | 2 | 4 |
| 12 | 14, 15 | 2 | 4 |
| 13 | 16, 17 | 2 | 5 |
| 14 | 18,19 | 2 | 5 |
| 15 | 20, 21, 22, 23 | 4 | 6 |
| 16 | 24, 25, 26 | 3 | 6 |
| 17 | 27, 28, 29 | 3 | 6 |
| 18 | 30, 31, 32, 33, 34 | 5 | 7 |
| 19 | 35, 36, 37, 38, 39, 40, 41, 42, 43 | 9 | 8; |

forward smoothing BSpe(b) according to: BSpe(b) =max (BSpe(b), BSpe(b-1)-4), b=1, . . . , Bmax;

backward smoothing BSpe(b);

after forward and backward smoothing, thresholding and renormalizing BSpe(b); and after thresholding and renormalizing BSpe(b), encoding at least a portion of the audio signal using BSpe(b).

2. The method of claim 1, wherein thresholding and renormalizing BSpe(b) comprises calculating: BSpe(b) =T(b)– max(BSpe(b),A(b)), for at least b=0, . . . ,17, wherein A(0)=8, A(1)=6, A(x)=3 for x=2, . . . ,15, A(16)=4, and A(17)=5.

3. The method of claim 2, further comprising calculating BSpe(b) =4 x (X/Y), wherein X =BSpe(b)−min(BSpe(b)), and Y=max(BSpe(b))−min(BSpe(b)).

4. The method of claim 2, further comprising adaptively companding BSpe(b).

5. The method of claim 2, further comprising adaptively expanding BSpe(b).

6. An encoding apparatus for use in encoding a signal, the encoding apparatus comprising:

a signal input for receiving an audio signal: and one or more data processors configured to:

obtain a spectrum (Spe(p));

map Spe(p) to a spectrum of perceptual sub-bands according to the following linear $$BSpe(b) = \frac{1}{Hb}\sum_{p \in J_b} Spe(p) + T_b,\ b = 0, \ldots, B_{MAX} - 1,$$

operation: where Bmax is an integer value not greater than 20 and the values of $H_b$, $T_b$ and $J_b$ are defined in table 1 as:

TABLE 1

Spectrum mapping constant

| b | $J_b$ | $H_b$ | $T_b$ |
|---|---|---|---|
| 0 | 0 | 1 | 3 |
| 1 | 1 | 1 | 3 |
| 2 | 2 | 1 | 3 |
| 3 | 3 | 1 | 3 |
| 4 | 4 | 1 | 3 |
| 5 | 5 | 1 | 3 |
| 6 | 6 | 1 | 3 |
| 7 | 7 | 1 | 3 |
| 8 | 8 | 1 | 3 |

TABLE 1-continued

Spectrum mapping constant

| b | $J_b$ | $H_b$ | $T_b$ |
|---|---|---|---|
| 9 | 9 | 1 | 3 |
| 10 | 10, 11 | 2 | 4 |
| 11 | 12, 13 | 2 | 4 |
| 12 | 14, 15 | 2 | 4 |
| 13 | 16, 17 | 2 | 5 |
| 14 | 18,19 | 2 | 5 |
| 15 | 20, 21, 22, 23 | 4 | 6 |
| 16 | 24, 25, 26 | 3 | 6 |
| 17 | 27, 28, 29 | 3 | 6 |
| 18 | 30, 31, 32, 33, 34 | 5 | 7 |
| 19 | 35, 36, 37, 38, 39, 40, 41, 42, 43 | 9 | 8; |

forward smooth BSpe(b) according to: BSpe(b) =max (BSpe(b), BSpe(b-1)-4), b=1, . . . , Bmax:

backward smooth BSpe(b);

after forward and backward smoothing, threshold and renormalize BSpe(b): and after thresholding and renormalizing BSpe(b), encoding at least a portion of the audio signal using BSpe(b).

7. The encoding apparatus of claim 6, wherein thresholding and renormalizing BSpe(b) comprises calculating: BSpe (b) =T(b)−max(BSpe(b),A(b)), for at least b=0, . . . , 17, wherein A(0)=8, A(1)=6, A(x)=3 for x=2, . . . ,15, A(16)=4, and A(17)=5.

8. The encoding apparatus of claim 7, wherein the encoding apparatus is further configured to calculate BSpe(b)=4 x (X/Y), wherein X=BSpe(b)−min(BSpe(b)), and Y=max (BSpe(b))−min(BSpe(b)).

9. The encoding apparatus of claim 7, wherein the encoding apparatus is further configured to adaptively compand BSpe(b).

10. The encoding apparatus of claim 7, wherein the encoding apparatus is further configured to adaptively expand BSpe (b).

* * * * *

UNITED STATES PATENT AND TRADEMARK OFFICE

CERTIFICATE OF CORRECTION

PATENT NO. : 9,153,240 B2
APPLICATION NO. : 13/939931
DATED : October 6, 2015
INVENTOR(S) : Briand et al.

It is certified that error appears in the above-identified patent and that said Letters Patent is hereby corrected as shown below:

In the Claims

In Column 7, Lines 11-14, delete " $\begin{cases} MT[b] = \max(MT[b], MT[b-1] - 12.5), b \in [2, \ldots, N_b] \\ MT[b] = \max(MT[b], MT[b+1] - 25), b \in [1, \ldots, N_b - 1] \end{cases}$ " and insert -- $$MT[b] = \max(MT[b], MT[b-1] - 12.5), b \in [2, \ldots, N_b]$$ $$MT[b] = \max(MT[b], MT[b+1] - 25), b \in [1, \ldots, N_b - 1].$$ --, therefor.

In Column 11, Line 12, in Claim 6, delete "signal:" and insert -- signal; --, therefor.

In Column 11, Line 20, in Claim 6, delete " $BSpe(b) = \frac{1}{Hb} \sum_{p \in J_b} Spe(p) + T_b, b = 0, \ldots, B_{MAX} - 1,$ " and insert -- $$BSpe(b) = \frac{1}{H_b} \sum_{p \in J_b} Spe(p) + T_b, b = 0, \ldots, B_{MAX} - 1,$$ --, therefor.

In Column 12, Line 17, in Claim 6, delete "Bmax:" and insert -- Bmax; --, therefor.

In Column 12, Line 20, in Claim 6, delete "BSpe(b):" and insert -- BSpe(b); --, therefor.

Signed and Sealed this
Sixteenth Day of August, 2016

Michelle K. Lee

Michelle K. Lee
*Director of the United States Patent and Trademark Office*